US010551046B1

(12) United States Patent
Tang

(10) Patent No.: US 10,551,046 B1
(45) Date of Patent: Feb. 4, 2020

(54) LIGHT ASSEMBLY

(71) Applicant: Yi-Wen Tang, Taichung (TW)

(72) Inventor: Yi-Wen Tang, Taichung (TW)

( * ) Notice: Subject to any disclaimer, the term of this patent is extended or adjusted under 35 U.S.C. 154(b) by 0 days.

(21) Appl. No.: 16/030,861

(22) Filed: Jul. 10, 2018

(51) Int. Cl.

| | |
|---|---|
| ***H05B 37/02*** | (2006.01) |
| ***F21V 15/015*** | (2006.01) |
| ***F21V 3/02*** | (2006.01) |
| ***F21V 31/00*** | (2006.01) |
| ***F21V 23/06*** | (2006.01) |
| ***F21S 4/20*** | (2016.01) |
| ***H01R 33/06*** | (2006.01) |
| ***F21S 2/00*** | (2016.01) |
| ***F21K 9/27*** | (2016.01) |
| ***F21K 9/272*** | (2016.01) |
| ***F21K 9/275*** | (2016.01) |
| ***F21V 21/005*** | (2006.01) |
| ***F21V 23/00*** | (2015.01) |
| *F21Y 103/10* | (2016.01) |

(52) U.S. Cl.
CPC ..... *F21V 23/003* (2013.01); *F21K 9/27* (2016.08); *F21K 9/272* (2016.08); *F21K 9/275* (2016.08); *F21S 2/005* (2013.01); *F21S 4/20* (2016.01); *F21V 3/02* (2013.01); *F21V 15/015* (2013.01); *F21V 21/005* (2013.01); *F21V 23/06* (2013.01); *F21V 31/005* (2013.01); *H01R 33/06* (2013.01); *H05B 37/0272* (2013.01); *F21Y 2103/10* (2016.08)

(58) Field of Classification Search
CPC . H01R 33/06–089; F21K 9/235; F21K 9/272; F21K 9/275; H05B 37/0272; F21S 2/00–005; F21S 4/20–28; F21V 21/005; F21V 21/06; F21V 23/06; F21V 23/001; F21V 23/002
See application file for complete search history.

(56) References Cited

U.S. PATENT DOCUMENTS

| | | | | |
|---|---|---|---|---|
| 8,232,724 | B2 * | 7/2012 | Mostoller | F21S 8/031 313/512 |
| 8,419,223 | B2 * | 4/2013 | Withers | F21S 2/00 362/254 |
| 8,454,193 | B2 * | 6/2013 | Simon | F21V 21/005 362/217.17 |
| 2012/0201021 | A1 * | 8/2012 | Todd | F21S 2/005 362/217.02 |
| 2013/0141890 | A1 * | 6/2013 | Carlin | F21V 23/026 362/20 |

(Continued)

*Primary Examiner* — Mariceli Santiago

(57) ABSTRACT

A light assembly includes at least one lighting set and at least one remote controller. The lighting set comprises a first units, two end members, two first plugs, at least one control member and at least one second plug. The first unit has multiple light members received therein. The two end members, the two first plugs, the at least one control member and the at least one second plug are assembled together correspondingly. The at least one control member is signally and electrically connected with two first plugs and the at least one second plug. The first plugs of two lighting sets are connected with each other by a first connection cable. The second plug connects to a power source by a first power cable. The at least one remote controller is for emitting control signals to the at least one control member so as to control the light members.

16 Claims, 13 Drawing Sheets

(56) References Cited

U.S. PATENT DOCUMENTS

2013/0343050 A1* 12/2013 Hu ..... F21V 23/06
362/217.16
2014/0009923 A1* 1/2014 Wu ..... F21V 29/70
362/218
2015/0300585 A1* 10/2015 Wu ..... F21V 21/112
362/222
2015/0364853 A1* 12/2015 Thijssen ..... F21V 23/06
439/660
2016/0369950 A1* 12/2016 Yeager ..... F21V 3/02

* cited by examiner

LIGHT ASSEMBLY

The present invention is a Continuation-In-Part application of applicant's former application with the application Ser. No. 15/862,622, filed on Jan. 4, 2018.

BACKGROUND OF THE INVENTION

1. Fields of the Invention

2. Descriptions of Related Art

The conventional light assembly is disclosed in FIG. 13, and comprises multiple light tubes 81 and each light tube 81 includes a fifth plug on each of two ends thereof. One sixth plug is located beside each fifth plug corresponding thereto. Multiple second power cables 82 are respectively connected to the sixth plugs of the multiple light tubes 81, and the multiple second power cables 82 are connected with a power source so as to provide electric power to activate the multiple light tubes 81. One second connection cable 83 is connected two respective fifth plugs of two light tubes 81 so that the light tubes 81 are activated simultaneously. It is noted that all of the light tubes 81 have to be connected to the second power cables 82 and the second connection cable 83 so as to be turned on and turned off simultaneously. The lengths of each second power cable 82 and each second connection cable 83 restrict the locations of the light tubes 81. The light tubes 81 are generally disposed at higher positions. The light tube 81 is connected to one end of the second power cable 82. The other end of the second power cable 82 is connected to the power source so that the light tube 81 is powered to emit light. Otherwise, when the light tubes 81 are to be turned off, the second power cables 82 need to be separated from the power source (generally, the second power cables 82 should be removed from the power source completely. Such way of use is very inconvenient.

The present invention intends to provide a light assembly that includes multiple light units, and the light units are controlled by wireless signals to eliminate the shortcomings of conventional art mentioned above.

SUMMARY OF THE INVENTION

The present invention relates to a light assembly which comprises at least one lighting set and at least one remote controller. The lighting set comprises a first units, two end members, two first plugs, at least one control member and at least one second plug. The first unit has multiple light members received therein. The two end members, the two first plugs, the at least one control member and the at least one second plug are assembled together correspondingly. The at least one control member is signally and electrically connected with two first plugs and the at least one second plug. The first plugs of two lighting sets are connected with each other by a first connection cable. The second plug connects to a power source by a first power cable. The at least one remote controller is for emitting control signals to the at least one control member so as to control the light members.

The advantages of the present invention are that the control member is controlled by a remote controller, the remote controller can control the light members turning on/off and powered on/off, and can tune the brightness of the light members in a distant place and without the necessary operation of plug in and out of connection cable and power cable.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
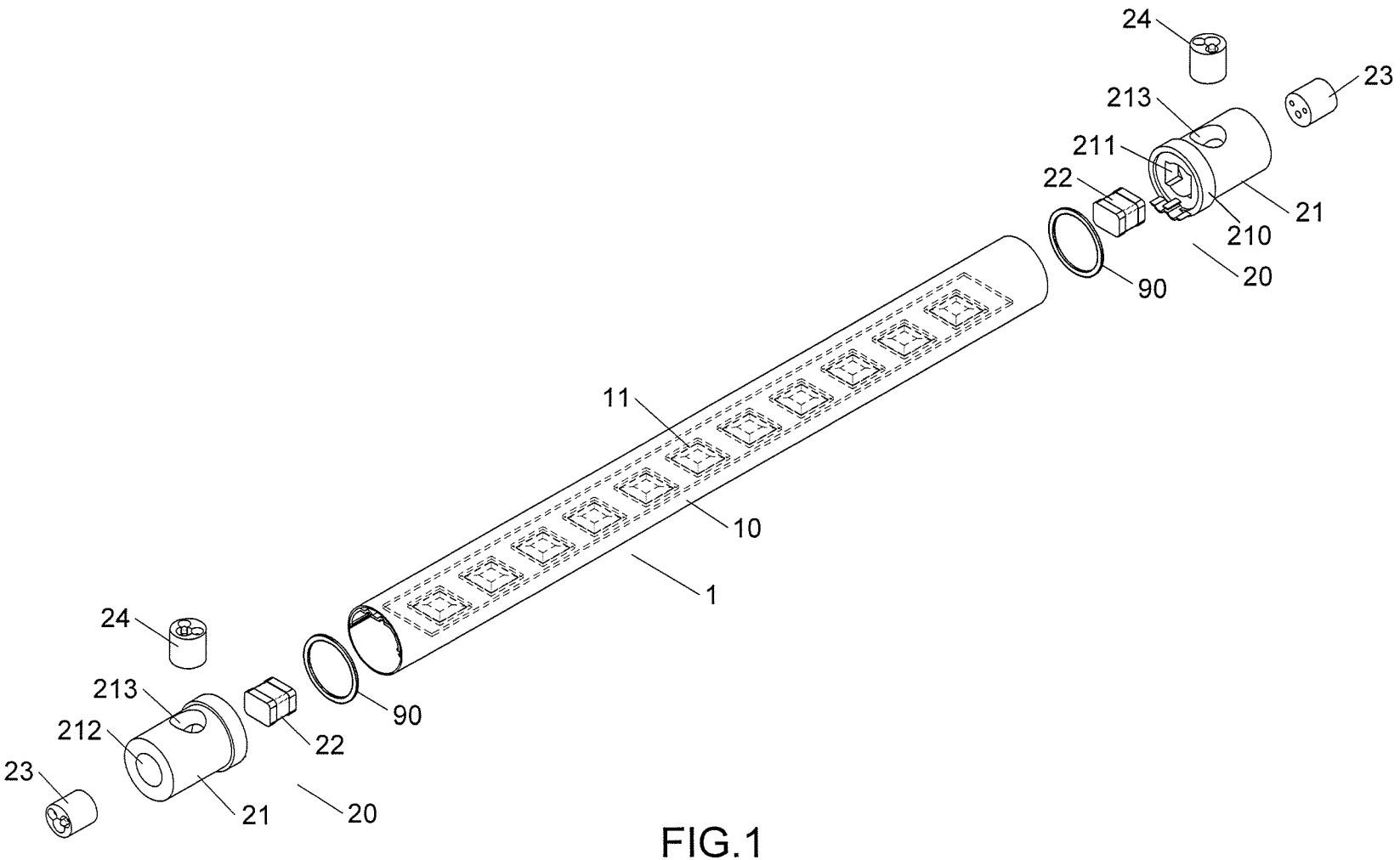
FIG. 1 is an exploded view of the light assembly of the present invention.
Figure 2:
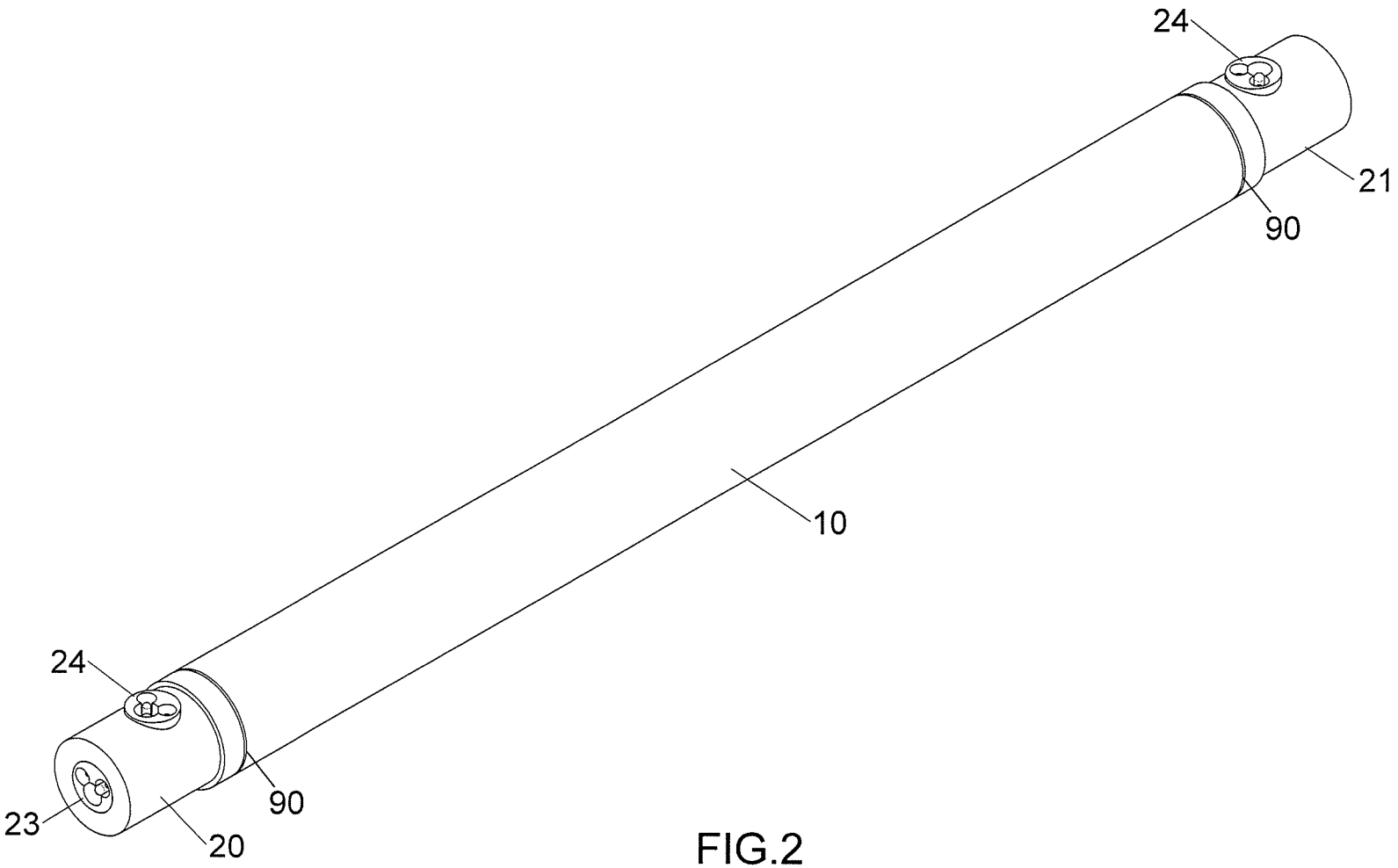
FIG. 2 is a perspective view to show the light assembly of the present invention.

Referring to FIGS. 1 to 5, the light assembly of the present invention comprises multiple lighting sets 1. Each lighting set 1 comprises multiple first units 10 each having multiple light members 11 received therein. The first units 10 each is an elongate tubular unit, and a transparent or translucent unit. The light members 11 distribute in the first unit 10 along a straight line and equally spaced, so that the light members can emit light beams to evenly pass through the first unit 10.

Two second units 20 are respectively connected to two open ends of each of the first units 10 so as to seal the two open ends of the first unit 10. Each second unit 20 includes an end member 21, a control member 22, a first plug 23 and a second plug 24. The end member 21 is a cylindrical member and mounted to the open end of the first unit 10 corresponding thereto. At least one seal ring 90 is located between the end member 21 and each of the two open ends of the first unit 10 so as to be water-tight. An outer periphery of one end of the end member 21 has a circular protrusion 210 which has an outer diameter being the same with that of the outer periphery of the open end of the first unit 10. The at least one seal ring 90 is positioned between and contacts against the circular protrusion 210 and the open end of the first unit 10.

For each second unit 20, the end member 21 has a first room 211 and a second room 212 respectively defined in two ends thereof. The first room 211 is a rectangular recess and communicates with the second room 212 which is a cylindrical recess. The end member 21 further has a third room 213 defined radially therein, and the third room 213 communicates with the first room 211 and the second room 212. The axis of the third room 213 is perpendicular to the axis of the second room 212. The third room 213 is a cylindrical recess.

The control member 22 is received in the first room 211 of the end member 21 and can be charged by a power source by wireless way or wired way. The control member 22 partially protrudes beyond the first room 211 of the end member 21. The control member 22 is provided with electric power by a power source through wireless way or wired way. The control member 22 provides electric power to the light members 11 so as to turn on or turn off the light members 11 simultaneously. The control member 22 is electrically connected to the light members 11 by wireless way or wired way. The light members 11 of each first unit 10 are electrically connected each other by an electric circuit so that all of the light members 11 of each first unit 10 can be signally controlled and powered by control member 22 of each first unit 10.

The first plug 23 is received in the second room 212 of the end member 21 corresponding thereto. The first plug 23 electrically connected to the control member 22 by wireless way or by wired way. In this embodiment, the first plug 23 is a female plug which can be any female plug in the market.

The second plug 24 is located in the third room 213 of the end member 21 and is electrically connected to the control member 22 by wireless way or by wired way. The second plug 24 is a female plug which can be any female plug in the market.

Figure 3:
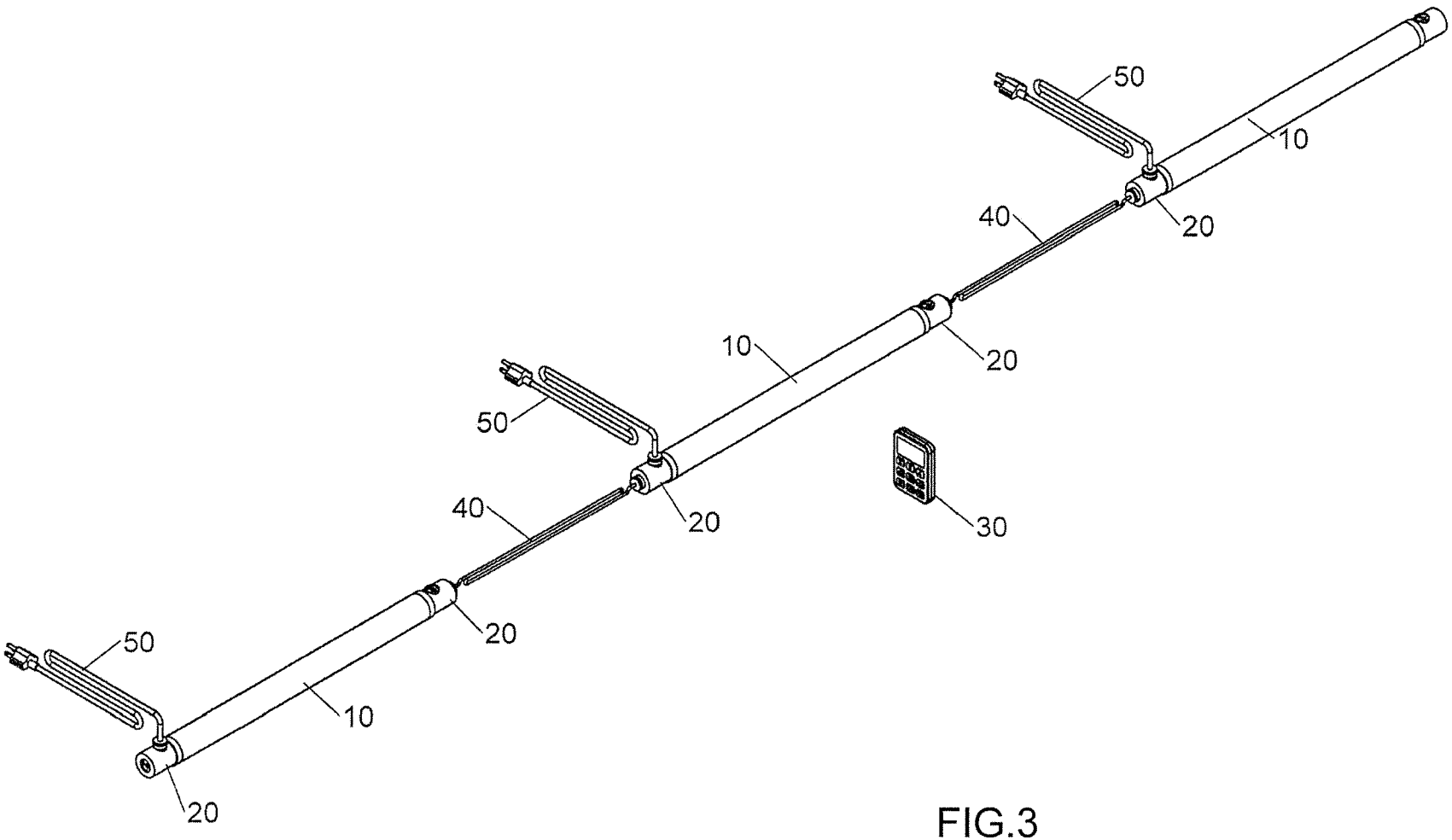
FIG. 3 is a perspective view to show the status of operation of the present invention.
Figure 4:
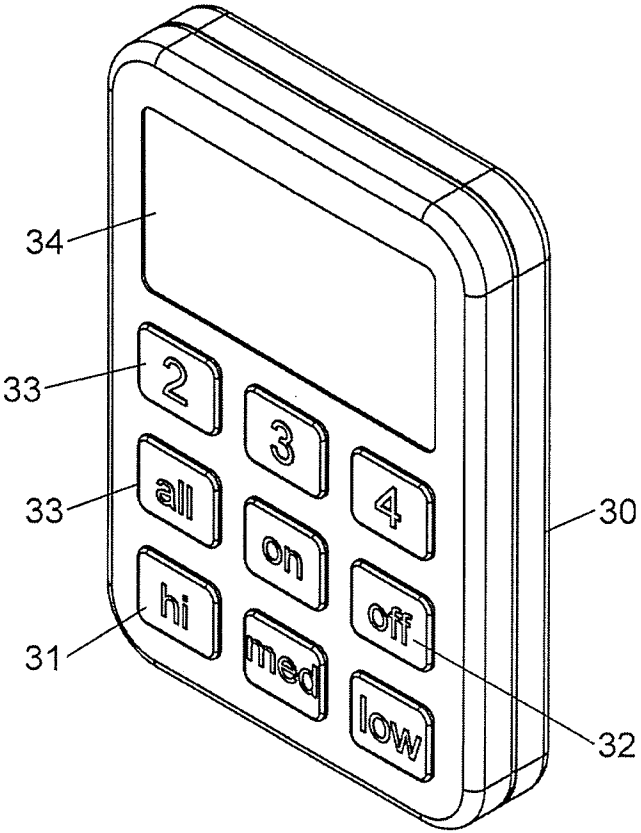
FIG. 4 is a perspective view to show the remote controller of the present invention.

Referring to FIG. 3, a remote controller 30 signally communicates with the control members 22 of the multiple second units 20 for emitting control signals to the control members 22, so that the control members 22 can control the light members 11 according to the control signals. The remote controller 30 has multiple first control buttons 31 for producing multiple control signals to control the light members 11 having multiple different degrees of brightness respectively. The remote controller 30 has multiple second control buttons 32 for producing multiple control signals to control the light members 11 in multiple statuses of turn on, turn off and switch on/off of power from the control member 22 respectively. The remote controller 30 has four third control buttons 33 for producing four control signals to control the light members 11 of four lighting sets 1, three lighting sets 1, two lighting sets 1 and one lighting sets 1 turning on respectively. The remote controller 30 has a display unit 34 for showing the status of use of the light members 11 of the lighting sets 1.

There are multiple first connection cables 40. Two ends of each first connection cables 40 are connected with two first unit 10 of two lighting sets 1 respectively through connecting to the first plugs 23 of the second units 20 of the two lighting sets 1.

There are multiple first power cables 50. One end of each first power cable 50 is connected with the lighting set 1 through connecting with the second plug 24 of the second unit 20. The other end of the power cable 50 has a plug which is connected to the power source, so that the first power cable 50 transmits electrical power to the control members 22 by wired way, and so that the remote controller 30 can transmit the control signals to the powered control members 22 for controlling the statuses of on/off and brightness of the light members 11.

Figure 5:
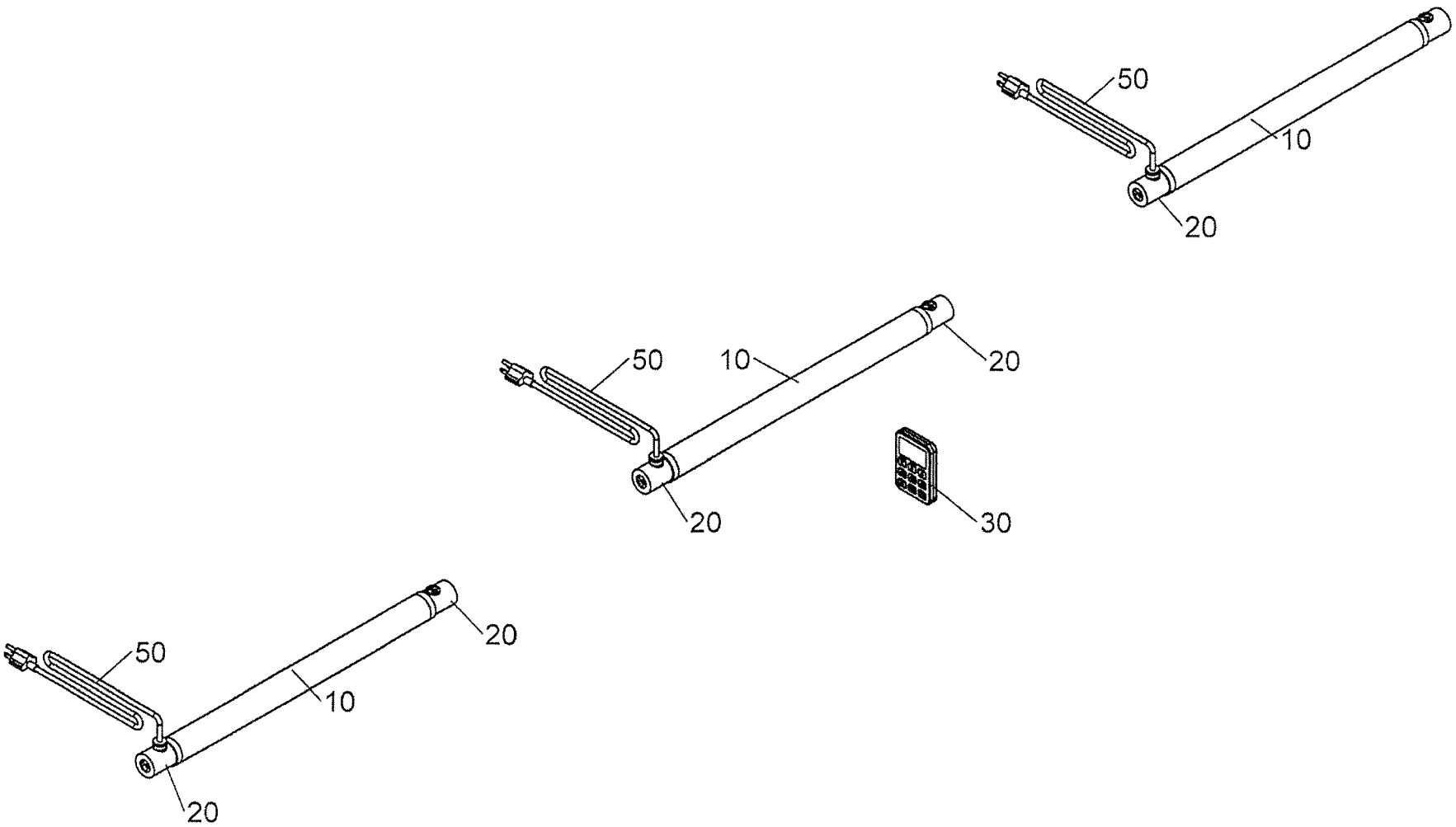
FIG. 5 shows a second embodiment of the light assembly of the present invention.

Referring to FIG. 5, it is noted that the multiple control members 22 of the multiple lighting sets 1 are signally communicated to each other wirelessly by using a common frequency so as to control the light members 11 of the multiple first units 10 of the multiple lighting sets 1 by one remote controller 30. In this embodiment, the common frequency is 433.2 MHZ. Multiple lighting sets 1 are signally communicated to each other by the control members 22 using the common frequency, so that each control member 22 can control the light members 11 to be turned on or turned off simultaneously.

Figure 6:
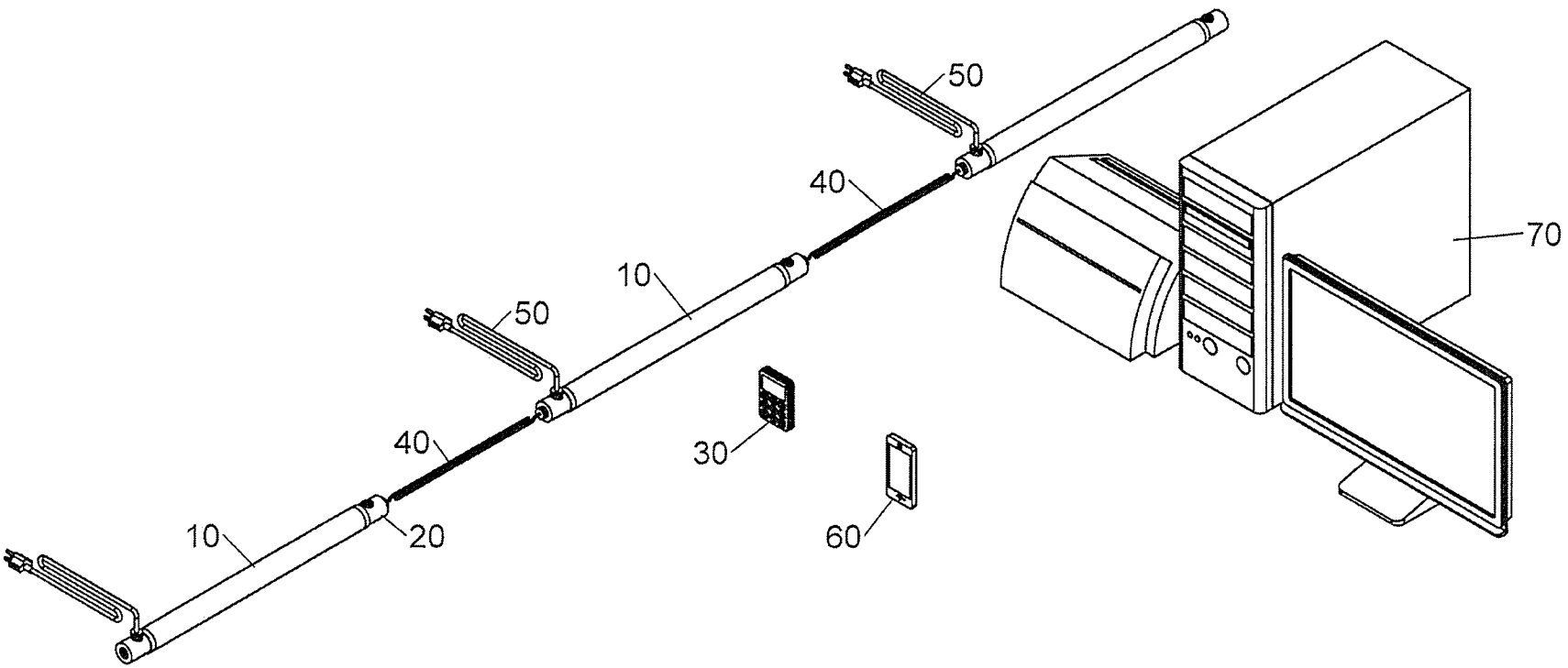
FIG. 6 shows a third embodiment of the light assembly of the present invention.

Referring to FIG. 6, the remote controller 30 signally communicates with a mobile or a computer by wireless connection, so that the remote controller 30 can transmit the information of using statuses to the mobile or the computer by wireless way, and so that a user can control the remote controller 30 by the mobile or the computer to control the statuses of on/off and brightness of the light members 11 of the first units 10.

Figure 7:
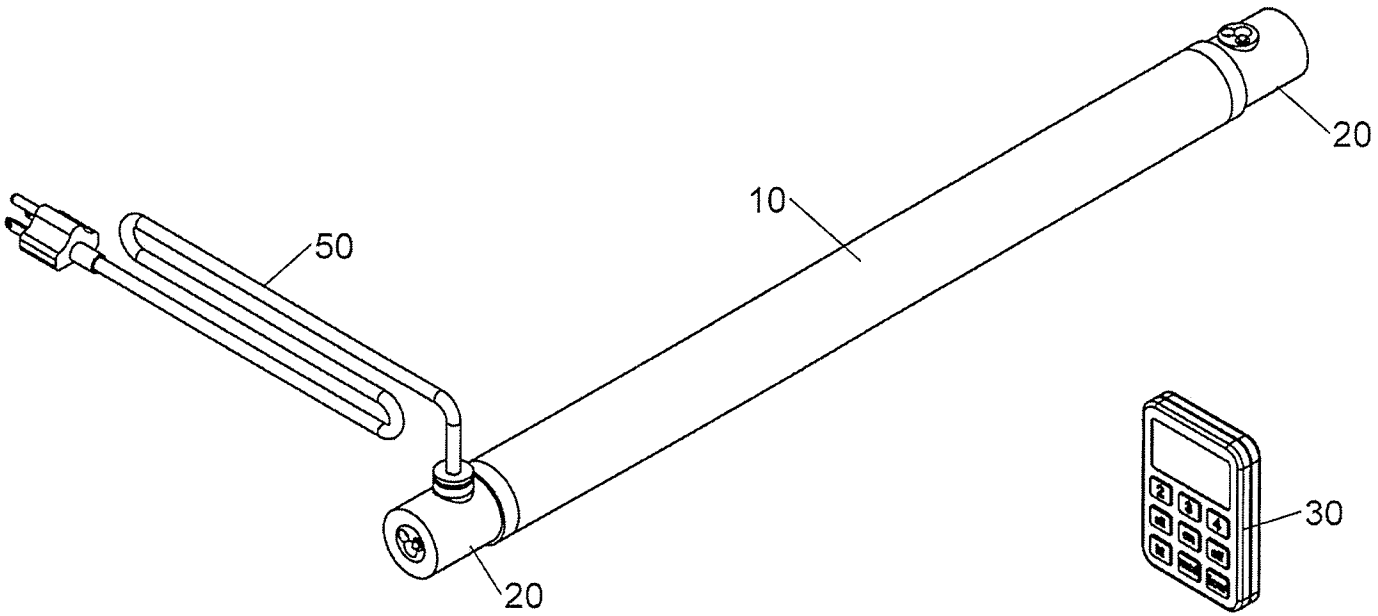
FIG. 7 shows a fourth embodiment of the light assembly of the present invention.

As shown in FIG. 7, there are one lighting set 1, one control member 22 and one first power cable 50. One remote controller 30 is signally communicated with the control member 22 of the lighting set 1 by wireless way. One remote controller 30 can control the control member 22 of the lighting set 1 by wireless way.

Figure 8:
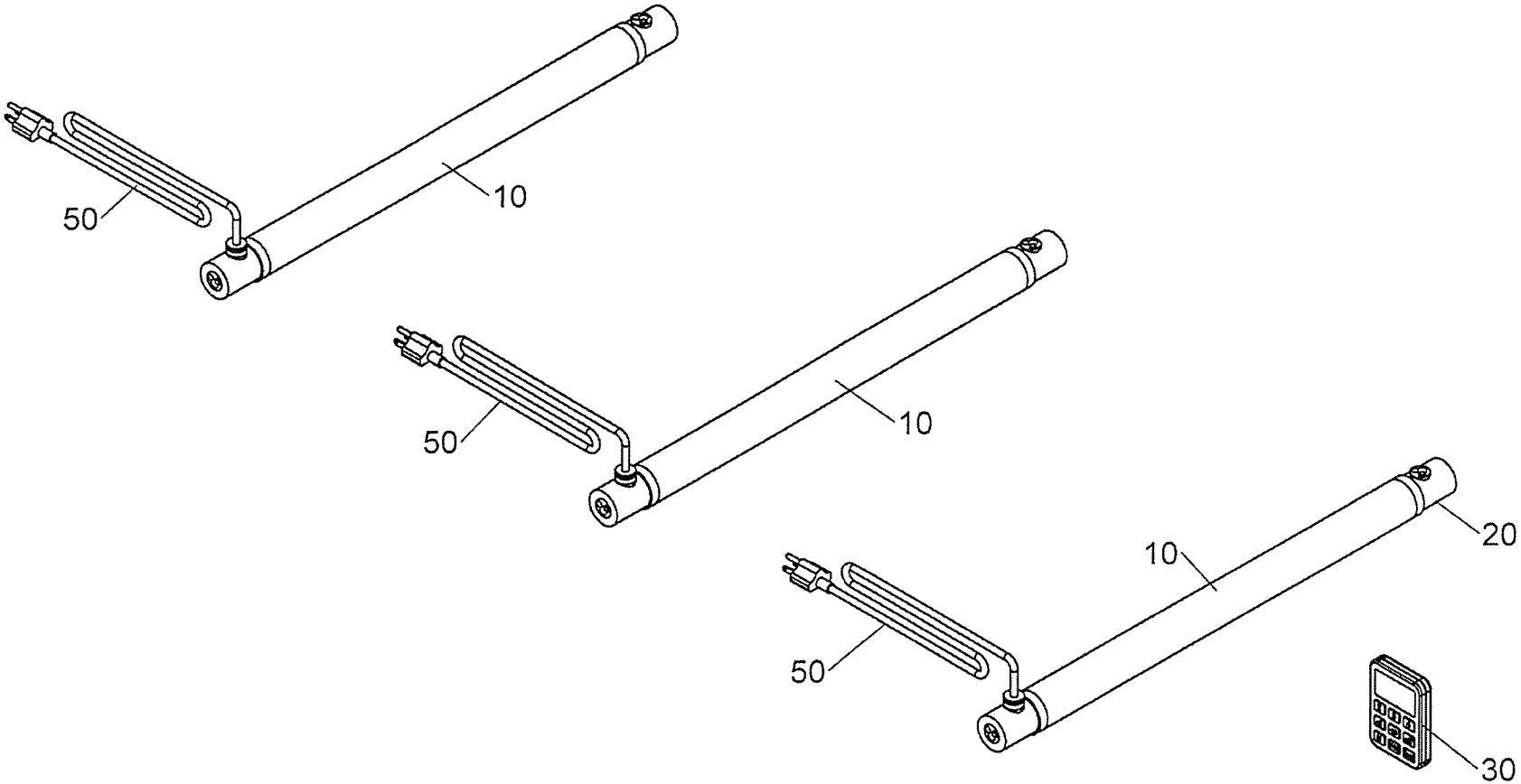
FIG. 8 shows a fifth embodiment of the light assembly of the present invention.

As shown in FIG. 8, there are multiple first power cables 50 and multiple lighting sets 1 each having at least one control member 22. One remote controller 30 is signally communicated with the at least one control member 22 of the multiple lighting sets 1 by wireless way. The one remote controller 30 can control the multiple control members 22 of the multiple lighting sets 1 by wireless way.

Figure 9:
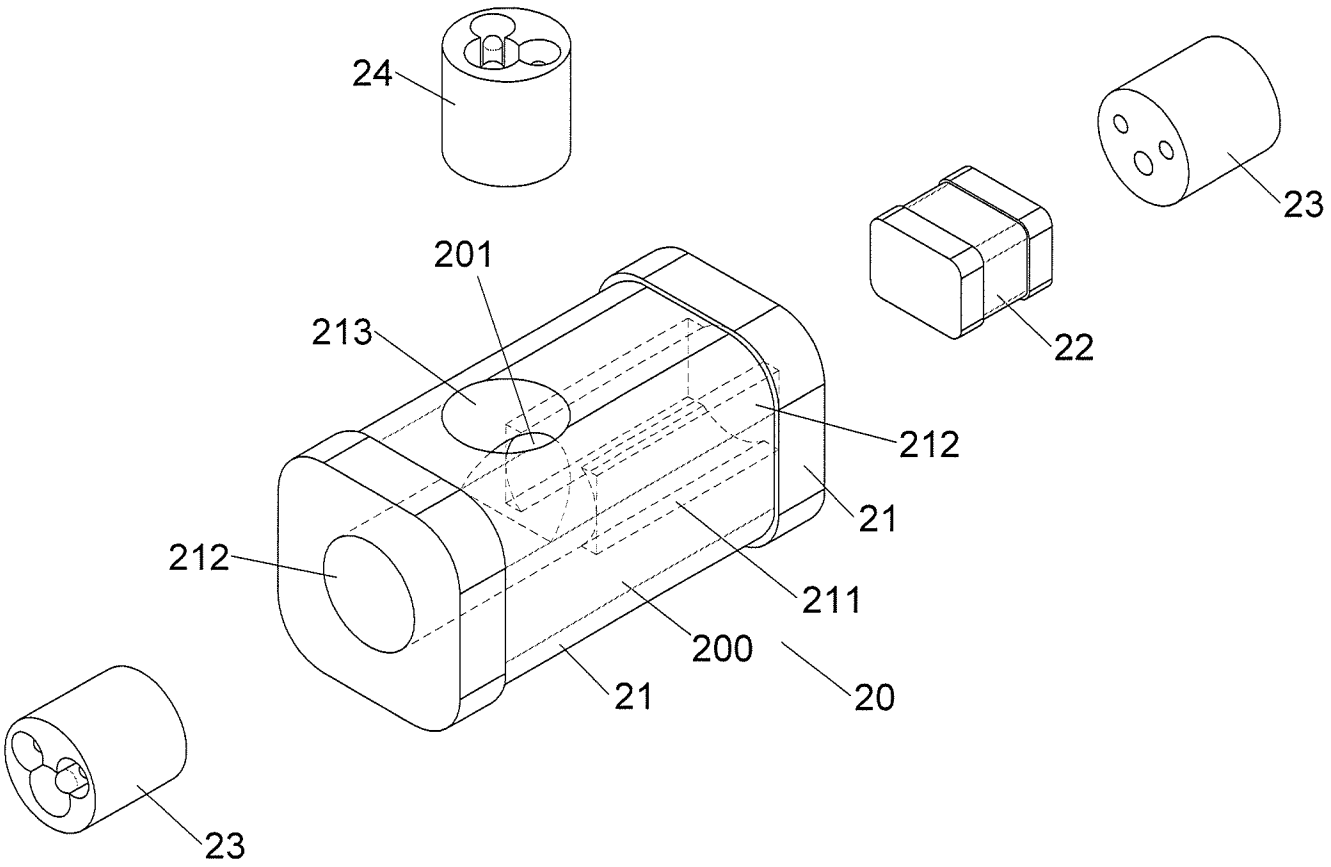
FIG. 9 shows a sixth embodiment of the light assembly of the present invention.
Figure 10:
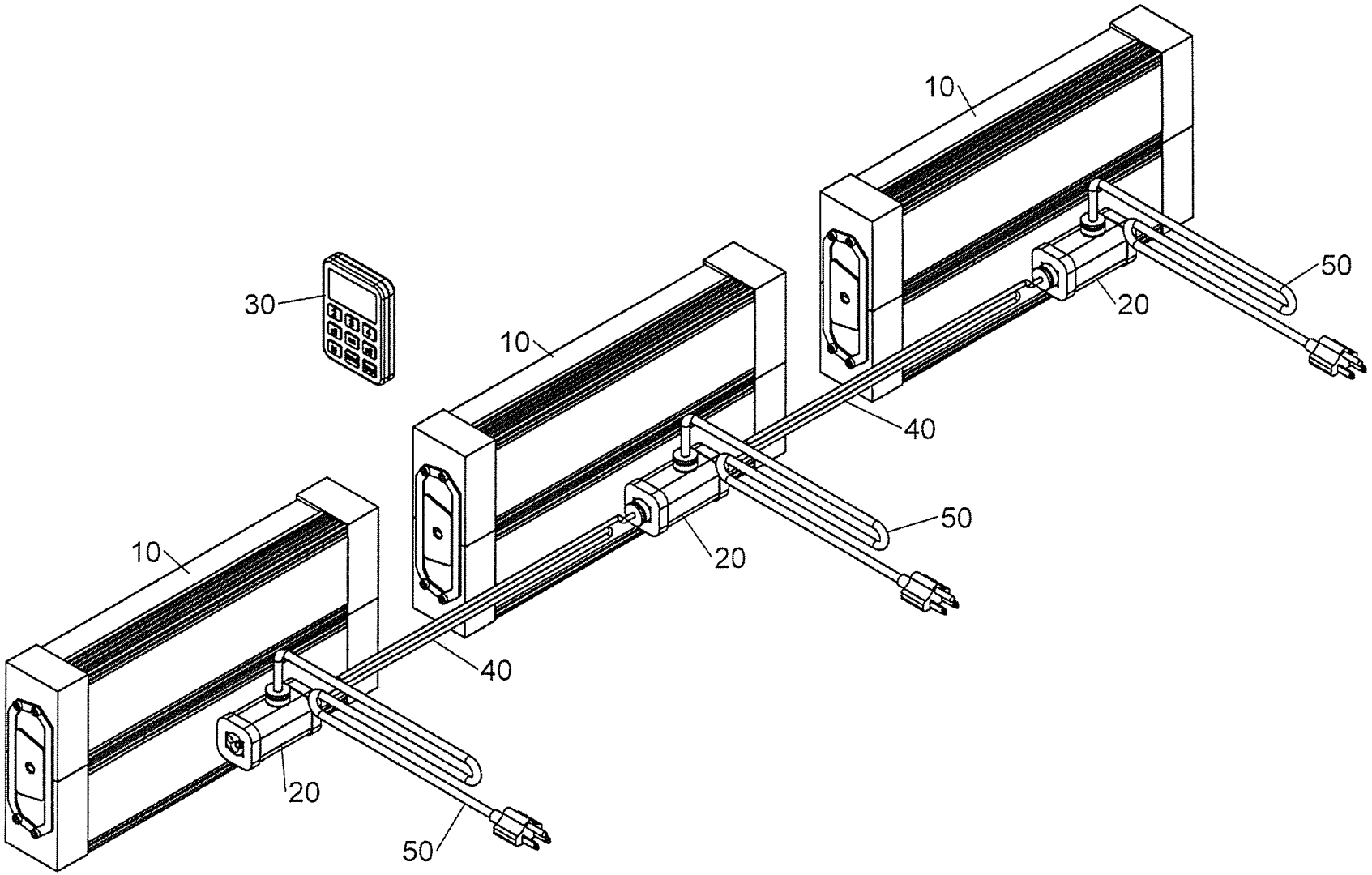
FIG. 10 shows a seventh embodiment of the light assembly of the present invention.
Figure 11:
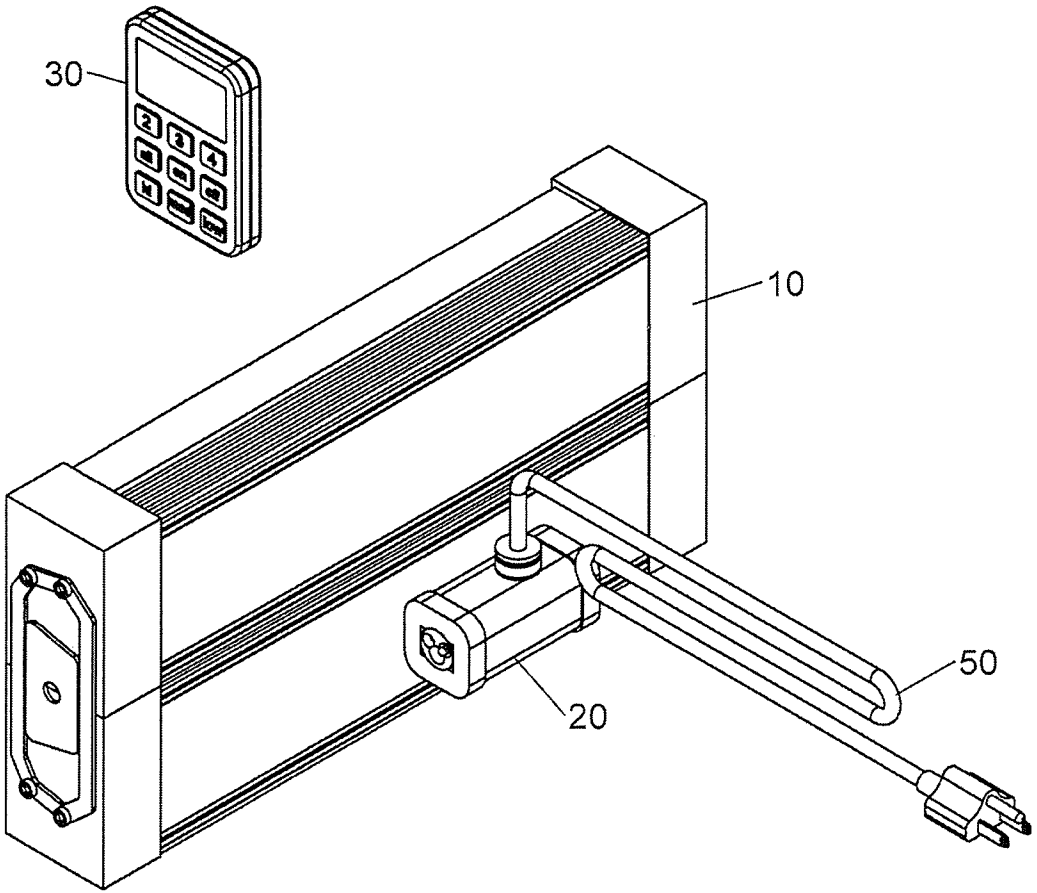
FIG. 11 shows an eighth embodiment of the light assembly of the present invention.

As shown in FIGS. 9 to 11, two end members 21 are integrally formed as an integral unit 200. Two opposite ends of the integral unit 200 have one second room 212 thereon respectively. The two first rooms 211 of the two end members 21 are formed together as an accommodating room 201 positioned at middle inner portion of the integral unit 200. The two second rooms 212 are communicated with each other through the accommodating room 201. The two second rooms 212 are mounted with one first plugs 23 respectively. The accommodating room 201 is mounted with at least one control member 22. The control member 22 is signally communicated with the two first plugs 23 in the two second rooms 212 of each integral unit 200. One second plug 24 is electrically connected with the two first plugs 23 of each integral unit 200 through the one control member 22. Referring to FIG. 10, the lighting sets 1 are formed in work lighting devices respectively. One side of each first unit 10 is equipped with one integral unit 200. Two first plugs 23 of two integral unit 200 on two adjacent first unit 10 are electrically connected each other by one first connect cable 40. One remote controller 30 can control all of the multiple control members 22 of the multiple lighting sets 1 by wireless way so as to control the multiple light members 11 of the multiple first unit 10 of the multiple lighting sets 1 by wireless way. Referring to FIG. 11, the lighting set 1 is formed in a work lighting device, one side of one first unit 10 is equipped with one integral unit 200. One remote controller 30 can control the at least one control member 22 on one first unit 10 of one lighting set 1 by wireless way so as to control the multiple light members 11 of the one first unit 10 of the one lighting sets 1 by wireless way.

Figure 12:
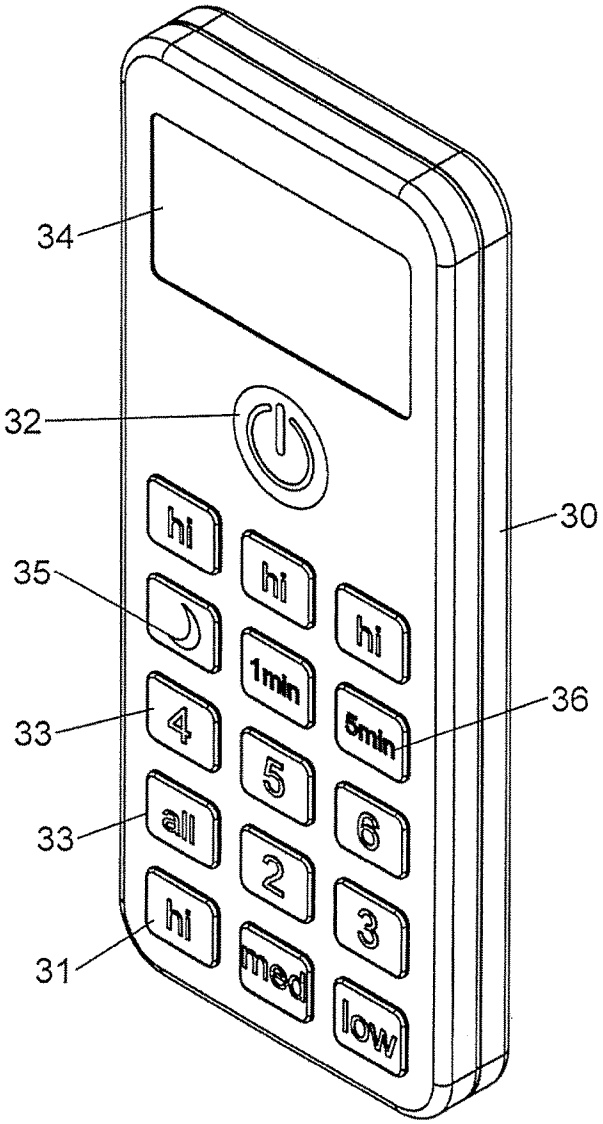
FIG. 12 shows a ninth embodiment of the light assembly of the present invention.
Figure 13:
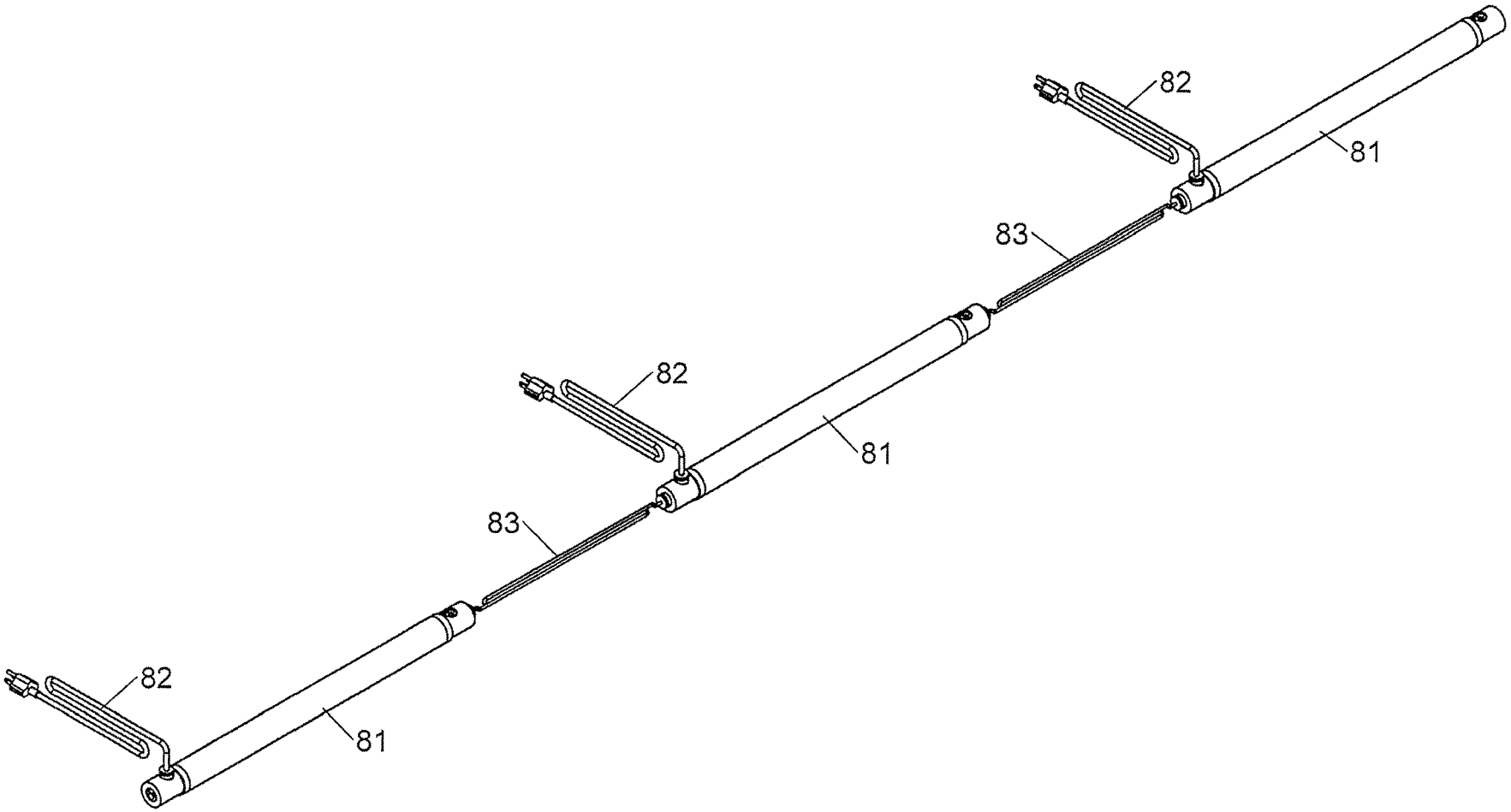
PRIOR ART FIG.13
FIG. 13 shows a conventional light assembly.

As shown in FIG. 12, the remote controller 30 has only one second control button 32 which is for controlling the lighting set 1 to turn on and off. The remote controller 30 has fourth control button 35 for tuning the brightness of the light member 11 of the lighting set 1 to have a 5~20% brightness of a largest brightness. The remote controller 30 has multiple fifth control button 36 each for setting a time of duration of lighting of the light member 11 of the lighting set 1.

The advantages of the present invention are that the remote controller 30 can control the control member 22 of each lighting set 1, so that the remote controller 30 can control the status of on, off and brightness of the light members 11 of the lighting set 1 through the control member 22. Whereby, the user need not to plug in and out between the first power cable and the power source as the conventional way.

One remote controller 30 can control multiple lighting set 1 so as to have better control effects. Generally, there are many lighting sets 1 installed in a place. Through the idea of the invention, the user only use one remote controller 30, and then he can control all of the lighting sets 1 so as to save his time of operation.

The remote controller 30 has multiple first control buttons 31, multiple second control buttons 32 and multiple third control buttons 33 for controlling the brightness of the light members 11, powered by the control member 22 or not and the number of activation of the multiple lighting sets 1 respectively. Whereby, the status of use of the lighting assembly of the present invention is expandable and ergonomic.

Referring to FIGS. 3 and 5, two lighting sets 1 electrically and signally connect with each other by one first connection cable 40 through the first plugs 23. The control members 22 of the multiple lighting sets 1 signally connect with each other by wireless way through a common frequency. Whereby, the multiple lighting sets 1 can signally connect with each other by wireless way and wire way.

Referring to FIG. 6, the remote controller 30 signally communicates with a mobile or a computer by wireless connection, so that the remote controller 30 can transmit the information of use statuses of the lighting sets 1 to the mobile or the computer by wireless way, and so that a user can control the remote controller 30 by the mobile or the computer to turn on and turn off the light members 11, and to switch the brightness of the light members 11 of the first units 10.

While we have shown and described the embodiment in accordance with the present invention, it should be clear to those skilled in the art that further embodiments may be made without departing from the scope of the present invention.

What is claimed is:

1. A light assembly comprising:

at least one lighting set, comprising:

a first unit having multiple light members received therein, and two end members being mounted to the first unit; each end member having a first room and a second room respectively; the first room communicating with the second room; each end member having a third room defined radially therein; the third room communicating with the first room and the second room; at least one control member being received in the first room of at least one end member and being adapted to be charged by a power source so as to provide electric power to the light members and control the light members to turn on or off simultaneously; a first plug being received in each second room of each end member, and the first plug electrically connected to the at least one control member by wireless way or by wired way; at least one second plug being located in the third room of at least one end member and being electrically connected to the at least one control member by wireless way or by wired way, and at least one remote controller signally communicating with the at least one control member for emitting control signals to the at least one control member so that the at least one control member controls the light members according to the control signals; the at least one control member being signally communicated to the remote controller wirelessly through a common frequency of 433.2 MHZ.

2. The light assembly as claimed in claim 1, wherein the first unit is an elongate tubular transparent or translucent unit; the light members emit light beams which pass through the first unit.

3. The light assembly as claimed in claim 2, wherein the light members are distributed in the first unit along a straight line and are equally spaced.

4. The light assembly as claimed in claim 2, wherein the first unit has two opposite open ends for receiving the two end members respectively; a seal ring is located between the end member and the first unit.

5. The light assembly as claimed in claim 4, wherein an outer periphery of one end of the end member has a circular protrusion which has an outer diameter being the same with that of an outer periphery of the open end of the first unit; the seal ring is positioned between and against the circular protrusion and the open end of the first unit.

6. The light assembly as claimed in claim 1, wherein the first room is a rectangular recess; the at least one control member is tight fit with the first room and partially protrudes beyond the first room of the end member.

7. The light assembly as claimed in claim 1, wherein the at least one lighting set comprises multiple lighting sets; two ends of a first connection cable connect to two first plugs of two end members of two lighting sets respectively; the second room is a cylindrical recess; the first plug is a female plug.

8. The light assembly as claimed in claim 1, wherein an axis of the third room is perpendicular to an axis of the second room, the third room is a cylindrical recess; the second plug is a female plug; two ends of a first power cable connect to the second plug and a power source so as to provide electric power for the at least control member.

9. The light assembly as claimed in claim 1, wherein the remote controller comprising: multiple first control buttons for producing multiple control signals to control the light members having multiple different degrees of brightness respectively; and multiple second control buttons for producing multiple control signals to control the light members in multiple statuses of turn on, turn off and powered by the at least one control member respectively.

10. The light assembly as claimed in claim 1, wherein the number of the at least one lighting set comprises multiple lighting sets; the remote controller has multiple control buttons for producing multiple control signals to control the light members of the multiple lighting sets turning on respectively.

11. The light assembly as claimed in claim 1, wherein the remote controller has a display unit for showing the status of use of the multiple light members.

12. The light assembly as claimed in claim 1, wherein the remote controller signally communicates with a mobile or a computer by wireless connection, so that the remote controller can transmit the information of use statuses to the mobile or the computer by wireless way, and so that a user can control the remote controller by the mobile or the computer to control the statuses of on/off and brightness of the light members.

13. The light assembly as claimed in claim 1, wherein the at least one lighting set and the at least one remote controller comprise multiple lighting sets and multiple remote controllers, respectively; each remote controller is for controlling the at least one control member of each corresponding lighting set.

14. The light assembly as claimed in claim 1, wherein the at least one lighting set comprises multiple lighting sets, the at least one remote controller is a single remote controller; the remote controller is for controlling the at least one control member of all of the multiple lighting sets.

15. The light assembly as claimed in claim 1, wherein the remote controller has a control button for tuning brightness of the multiple light members between 5~20% of a largest brightness.

16. The light assembly as claimed in claim 1, wherein the remote controller has multiple control buttons each for setting a time of duration of lighting of the multiple light members respectively.

* * * * *